United States Patent [19]

Goffney et al.

[11] Patent Number: 4,906,002

[45] Date of Patent: Mar. 6, 1990

[54] RACQUET WITH REINFORCED THROAT DETACHABLE HANDLE

[76] Inventors: Janice F. Goffney, 2468 Gladstone St., Detroit, Mich. 48206; Maurice T. Gray, 19600 Greeley, Detroit, Mich. 48203

[21] Appl. No.: 189,346

[22] Filed: May 2, 1988

[51] Int. Cl.[4] ..... A63B 49/02

[52] U.S. Cl. ..... 273/73 G; 273/73 J

[58] Field of Search ..... 273/73 R, 73 C, 73 J, 273/73 G, 73 H, 73 L, 75, 67 R, 67 DA, 67 DB, 29 H, 193 B

[56] References Cited

U.S. PATENT DOCUMENTS

| | | | |
|---|---|---|---|
| 1,541,829 | 6/1925 | Larned | 273/73 J |
| 2,109,799 | 3/1938 | Moore | 273/73 R |
| 3,033,575 | 5/1962 | Hause | 273/193 B |
| 3,833,218 | 10/1974 | Frenkel et al. | 273/73 J |
| 4,007,929 | 2/1977 | Figa | 273/73 J |
| 4,033,583 | 7/1977 | Ehrhart | 273/73 J |
| 4,165,071 | 8/1979 | Frolow | 273/73 G |
| 4,367,871 | 1/1983 | Schiefer | 273/29 A |
| 4,641,838 | 2/1987 | Gabrielidis | 273/73 J |
| 4,746,119 | 5/1988 | Jeanrot | 273/73 J |

FOREIGN PATENT DOCUMENTS 1903722 8/1970 Fed. Rep. of Germany .... 273/73 C

*Primary Examiner*—Edward M. Coven
*Assistant Examiner*—William E. Stoll
*Attorney, Agent, or Firm*—Dykema Gossett

[57] ABSTRACT

A tennis racquet has a detachable handle. The racquet has a frame with an open portion that surrounds a stringed hitting surface. Extending convergently toward one another from the open frame to free ends are two frame fork members. The The detachable handle includes a forked end, a grip end, and a gripping shank. The forked end has two handle fork members, which correspond to the frame fork members. The handle fork members are secured to and extend from the gripping shank to free ends, while diverging from one another. Keying and locking mechanisms are assembled to rigidly attach each handle fork member to a corresponding frame fork member at their free ends. The locking mechanisms may be disassembled to permit each handle fork member to be detached from a corresponding frame fork member and to permit the handle to be detached from the frame.

5 Claims, 2 Drawing Sheets

RACQUET WITH REINFORCED THROAT DETACHABLE HANDLE

FIELD OF INVENTION

The present invention relates to a racquet with a reinforced and detachable handle and, more particularly, to a fork-type racquet with reinforcing elements that stabilize the racquet against shock from a colliding ball and allow the handle to be detached and attached again without sacrificing the stability just described.

BACKGROUND OF THE INVENTION

A known type of tennis racquet has strings stretched across an open frame to which a handle having a fork neck is attached. The fork-like structure has at least two advantages: it reduces the material and thereby the weight in the neck of the handle, and it reduces the wind resistance that would be the consequence of a substantial amount of wind-resisting material in a wide neck area.

A racquet having a fork-like structure is advantgeous without sacrificing the advantage of the stability that accompanies the wide, flat neck racquet. Accuracy or trueness of the racquet depends on a tangential transition of the neck between the frame and the handle. Where this transition is accomplished by a fork structure, trueness requires that the fork extensions and the frames lie substantially in a common plane with respect to the handle, so that only minimal twisting should be tolerated.

A ball colliding with the strings of the racquet imparts considerable force, and when the ball collides with the racquet at a point remote from the center of the frame, the force of the collision is translated into a twisting moment about the axis of the handle. The moment tends to twist the frame askew from the plane in which the fork structure lies, making the racquet less true. The less true the racquet, the less a tennis player is able to predict the trajectory of a rebounding ball, so that the player finds it difficult to place the ball on the court at a particular location, which is essential to the strategy of a controlled game of tennis.

Control is also is affected by the dimensional stability of the racquet. A player becomes familiar with a handle of a certain length and by whatever twist accompanies it. Consequently, dimensional stability sets the length of the racquet, and this works to another disadvantage: even if it has a standard length handle, a racquet requires considerable space to be either stored or carried in a bag for travel.

PRIOR ART

A device disclosed in U.S. Pat. No. 4,635,936, issued to Becker et al. on June 8, 1976, describes an inflatable tennis racquet that requires little space for storage or transport. This racquet, however, suffers from the disadvantage of being so structurally different from a conventional racquet. As a result of this, a player suffers unpredictability of play with the Becker racquet because of a lack of familiarity with the racquet. Moreover, the racquet is adapted to play with soft, foam plastic balls, and, accordingly, is a device for use in a wholly different game.

Devices disclosed in U.S. Pat. No. 4,545,584, issued to Adam on Oct. 8, 1985, and U.S. Pat. No. 4,641,838, issued to Gabrielidis on June 8, 1976, describe tennis racquets with adjustable length handles. In either case, adjustment may be made to the extent at which the handle is detached from the frame. In neither case is there a detachment at the neck of the handle so that the wide frame, with dimensional requirements different from the requirements for the handle itself, may be packed separately for storage or transporting. Nor is there a teaching or suggestion that the racquet may be reduced to the length of the frame.

OBJECTS OF THE INVENTION

Accordingly, it is a primary object of the present invention to provide a tennis racquet that requires little space for storage or transport, while being so structurally like a conventional racquet as to be familiar to a player so that he or she is able to predict play when using it.

Moreover, it is an object of the present invention to provide a tennis racquet that requires little space for storage or transport, while being structurally like a conventional racquet so as to be adapted to play with conventional tennis balls.

It is another object of the present invention to provide a tennis racquet that requires no more space for storage or transport than the extension of the racquet from the top of the frame to the neck of the handle.

It is yet another object of the present invention to provide a tennis racquet that is a structural enhancement of a conventional racquet while being used in play and that is adaptable to a lengthwise dimension that is little if any more than the lengthwise dimension of the frame of the racquet so that the racquet may be conveniently packed for storage or transporting.

SUMMARY OF THE INVENTION

According to the present invention, a tennis racquet has a detachable handle. The tennis racquet is comprised of a frame that includes an open frame portion surrounding a stringed hitting surface. Two frame fork members extend in convergence toward one another, each extending from the open frame to a frame fork member free end.

The handle includes a forked end, a grip end, and a gripping shank. The gripping shank is disposed between the forked end and the grip end and has a substantially uniform cross-section over a portion of its length adjacent the grip end. The forked end has two handle fork members which each correspond to a frame fork member. Each handle fork member is secured to and extends from the gripping shank to a handle fork member free end, while diverging from the other handle fork member.

Means, which may be positioned with respect to the handle and frame, are provided for keying and locking each handle fork member to a corresponding frame fork member and thereby rigidly attaching the handle to the frame. In a first relationship, the means so provided bridge at least a portion of the joints between the corresponding fork members. In a second relationship, the means so provided permit each handle fork member to be detached from a corresponding handle fork member so that the handle becomes detachable from the frame.

DETAILED DESCRIPTION OF THE PREFERRED EMBODIMENTS

Figure 1:
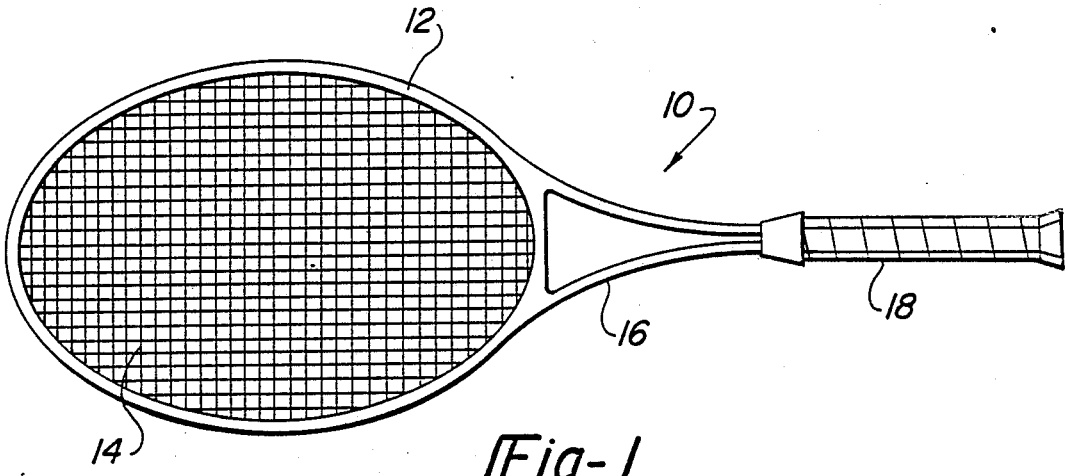
Fig-1 PRIOR ART
FIG. 1 is a front or rear elevational view of a conventional forktype racquet.

A conventional racquet 10, in particular tennis racquet, is shown in FIG. 1 as having an open frame 12 with strings 14 strung across the opening of the frame 12. The racquet 10 has fork members 16 integrally joining the frame 12 to a gripping shank 18. The construction of the tennis racquet 10 meets requisite standards for size, shape, and material make-up, so that the racquet 10 may be sized and shaped to meet the standards for sanctioned tournament play, and the frame may be made of metal, wood, or synthetic polymer composition material. A racquet in which any of the embodiments of the present invention is incorporated would not be unlike a conventional racquet with respect to all of the foregoing specifications, except that the gripping shank 18 would not be integrally joined to the frame 12 by the fork members 16.

Figure 2:
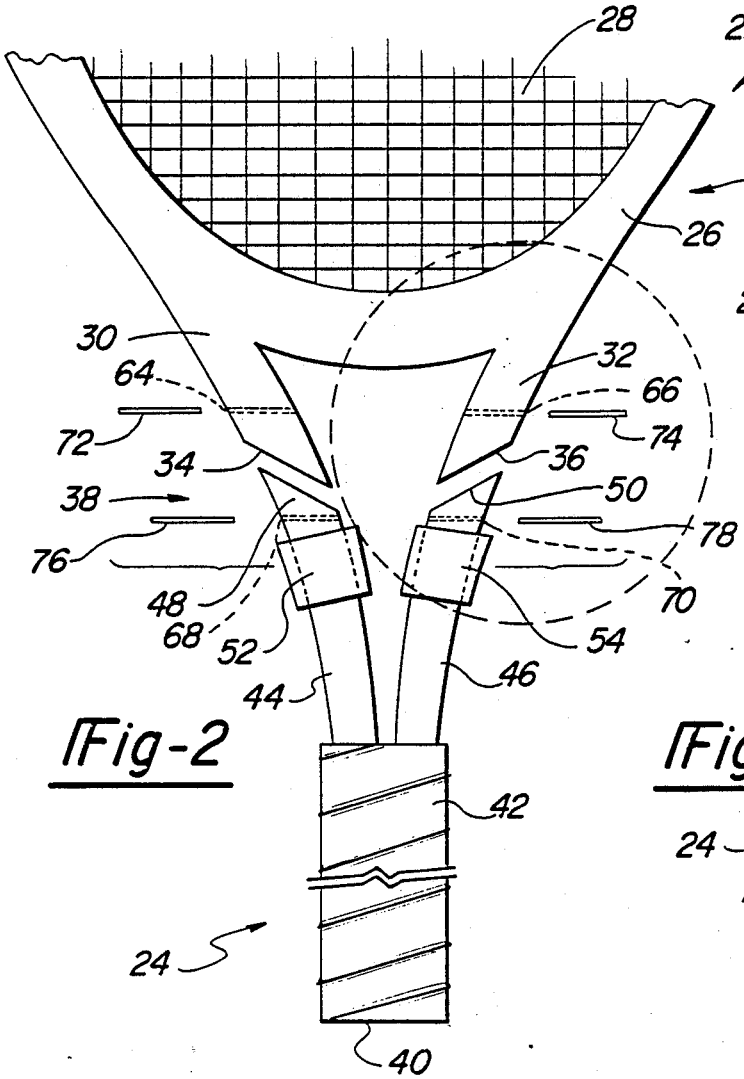
FIG. 2 is an enlarged, exploded partial front and rear elevational view of a racquet in accordance with a first embodiment of the present invention.

A racquet 20 incorporating a first embodiment of the present invention is shown in FIG. 2 as also incorporating the essential features of a conventional racquet 10 shown in FIG. 1. The racquet 20, shown in FIG. 2, has a frame, generally indicated as at 22, and a handle generally indicated as at 24.

Figure 3:
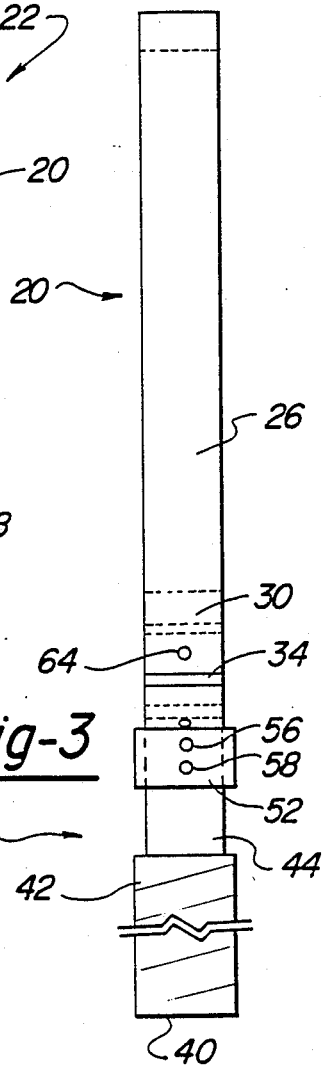
FIG. 3 is an enlarged, partial left elevational view of the racquet of FIG. 2.
Figure 6:
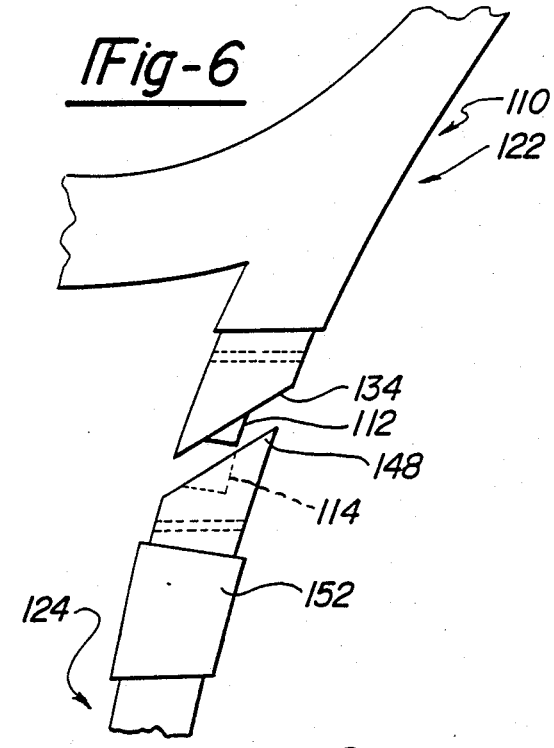
FIG. 6 is an enlarged detail of a second embodiment of the invention corresponding to the portion of the first embodiment indicated as within the dashed circle of FIG. 2.
Figure 7:
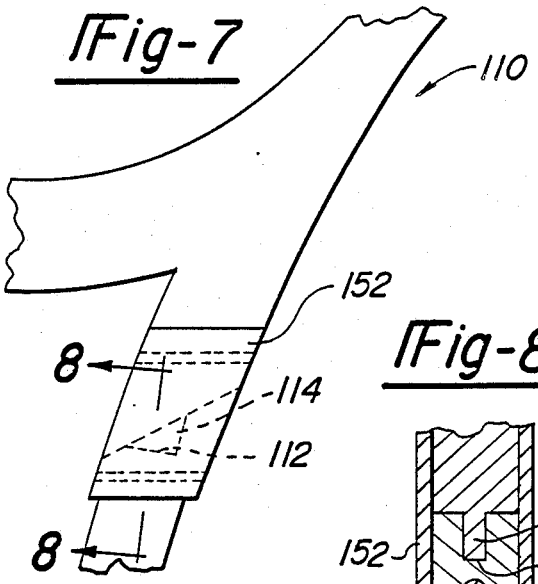
FIG. 7 is a detail of the embodiment shown in FIG. 6 with a keying and locking mechanisms in place to rigidly attach the handle of the racquet to the frame of the racquet.
Figure 8:
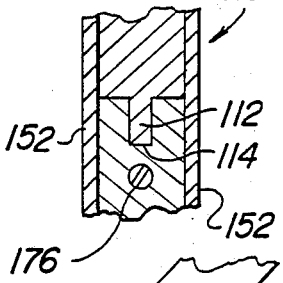
FIG. 8 is a cross-sectional view of the portion of the racquet shown in FIG. 7, taken in the direction of arrows 8—8.

Referring now to FIG. 3 in addition to FIG. 2, the frame 22 includes an open frame portion 26 that surrounds a stringed hitting surface 28. Extending from the open frame portion 26 are two frame fork members 30 and 32. Each frame fork member 30 or 32 extends from the frame and converges toward the other frame member 32 or 30, but stops short at a frame fork member free nd 34 or 36. The frame fork member free ends 34 and 36 are shown with particularity in FIG. 2 where they are shown as having surfaces that slope outwardly from the convergence of the two frame fork members 30 and 32.

Still referring to FIGS. 2 and 3, the handle 24 is shown as an autonomous structure, separate from the structure of the frame 22. The structure of the handle 24 includes a forked end shown generally at 38, a grip end 40, and a gripping shank 42.

The gripping shank 42 is shown as disposed between the forked end 38 and the grip end 40. As is known within the art, the gripping shank 42 is preferably covered with a layer or layers of material, with at least the outermost layer having a surface suitable for gripping, as for example a leather surface. Preferably, the gripping shank has a substantially uniform cross-section over a portion of its length adjacent the grip end 40, although this is not a limitation with respect to the invention.

The forked end 38 has two handle fork members 44 and 46. Handle fork members 44 and 46 have handle fork member free ends 48 and 50, respectively, that correspond to frame fork member free ends 34 and 36. Accordingly, the surfaces of the handle fork member free ends 48 and 50 respectively match the surfaces of the frame fork member free ends 34 and 36 when the handle 24 is attached to the frame 22, as shown in FIG. 3, in a manner to be hereinafter described. The matching surfaces of the handle fork member free ends 44 and 50 and the frame fork member free ends 34 and 36 provide means for keying the handle 24 to the frame 22.

As can be understood by the example of one handle fork member 44, each handle fork member 44 is secured to and extends from the gripping shank 42 to a handle fork member free end 48, while diverging from the other handle fork member 46 which extends from the gripping shank to a handle fork member free end 50. As will be apparent as an advantageous structural feature for a first embodiment of the present invention, each handle fork member 44 and 46 tapers from the gripping shank 42 so as to have a cross-section proximate handle fork member free end 48 or 50 that is thicker than the cross-section proximate the gripping shank 42.

A means is provided for rigidly attaching each handle fork member 44 or 46 to a corresponding frame fork member 30 or 32. With respect to the first embodiment shown in FIG. 2, slide couplings 52 and 54 provide positional means to bridge the joints between the matching surfaces of the handle fork member free ends 48 and 50 and the frame fork member free ends 34 and 36, when each of the positional means of slide couplings 52 and 54 is placed in a first position shown in FIG. 3, and keying and locking means of the racquet 20 are in a first relationship.

Slide couplings 52 and 54 substantially surround handle fork members 44 and 46 (see FIG. 5) proximate handle fork member free ends 48 and 50, and slide couplings 52 and 54 are capable of substantially surrounding frame fork members 30 and 32 proximate frame fork member free ends 34 and 36. Slide couplings 52 and 54 also have tapering interior walls to match the taper of handle fork members 44 and 46 so as to fit snugly on frame fork members 30 and 32 and respective handle fork members 44 and 46, as they are respectively joined at matching surfaces of handle fork member free ends 48 and 46 and frame fork member free ends 34 and 36 when each of the positionable means of slide couplings 52 and 54 is placed in the first position. The snug fit of slide couplings 52 and 54 on handle fork members 44 and 46, when each slide coupling 52 or 54 is in the first position, keeps slide couplings 52 and 54 from falling off handle fork members 44 and 46 when frame 22 is detached from handle 24.

As can be seen in FIG. 3, which is an elevation of the left side of racquet 20 as shown in FIG. 2, but which is an appropriate elevation for either side of racquet 20, slide coupling 52 has holes 56 and 58. Slide coupling 54 also has a pair of holes which are not seen in the views. All of the holes, for example holes 56 and 58, communicate between the interior and exterior of respective slide coupling, in the example, slide coupling 52.

Figure 4:
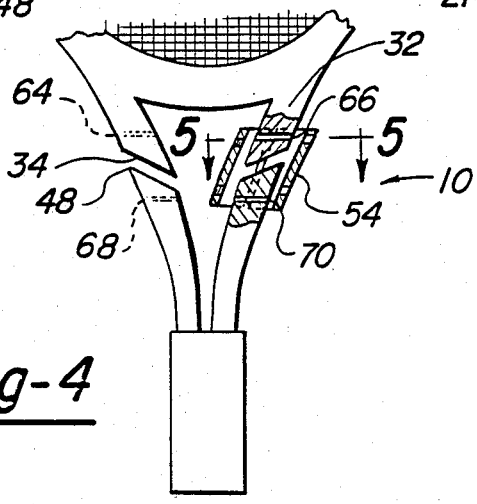
FIG. 4 is a sectional detail of a slide coupling on the racquet as shown in FIG. 2.
Figure 5:
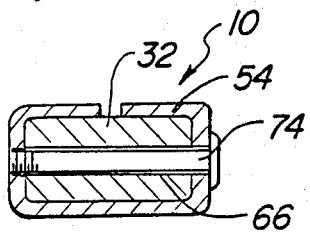
FIG. 5 is a cross-sectional view of the portion of the racquet shown in FIG. 4, taken in the direction of arrows 5—5.

Reference will still be made to FIGS. 1–3, but now also to FIGS. 4 and 5. Frame fork members 30 and 32 have threaded holes 64 and 66, respectively, which extend substantially through frame fork members 30 and 32 and which open to communicate with the holes of the slide couplings, for example hole 56 of slide couplings 52, when each of slide couplings 52 and 54 is placed in a first position shown in FIG. 4. In this position, threaded screws or threaded dowel pins 72 and 74 are threadedly received through hole 56 and the upper hole in slide coupling 54, into holes 64 and 66 to secure slide couplings 52 and 54 to frame fork members 30 and 32 in the first relationship. Similarly, handle fork members 44 and 46 have threaded holes 68 and 70, respectively, which extend substantially through handle fork members 44 and 46 and which open to communicate with holes in slide couplings 52 and 54, for example hole 58 of slide coupling 52, when each of slide couplings 52 and 54 is placed in a first position shown in FIG. 4. In this position, threaded screws or threaded dowel pins 76 and 78 are threadedly received through hole 58 and the lower hole in slide coupling 54 into holes 68 and 70 to secure slide couplings 52 and 54 to handle fork members 44 and 46 in the first relationship. The racquet is thus stabilized for play, and the slide couplings 52 and 54 provide a structural enhancement for an otherwise conventional racquet as it used in play.

The handle fork members 44 and 46 may be detached from the frame fork members 30 and 32 by removing threaded screws or threaded dowel pins 72, 74, 76 and 78 to release slide couplings 52 and 54, so that slide couplings 52 and 54 may be positioned as shown in FIG. 2. With slide couplings 52 and 54 so positioned, handle 24 may be removed from fork 22 and handle 24 and frame 22 may be stacked together or placed apart for storage, transporting or both. Accordingly, racquet 20 is adaptable to a lengthwise dimension that is little if any more than the lengthwise dimension of the frame 22, so that racquet may be conveniently packed for storage or transporting.

As illustrated in FIGS. 6–10, a number of devices may be used to assure structural stability for play and structural enhancement in accordance with the present invention. For racquet 110, shown in FIGS. 6–8, a wedge 112 projects from each frame fork member free end 134 (only frame fork member free end 134 being shown). The wedge 112 is seated in a wedge-accommodating notch 114 of handle fork member free end 148, as shown in phantom in FIG. 7 (again, only one handle fork member free end 148 being shown) and as shown in cross-section in FIG. 8. As in the first embodiment of the invention shown in FIGS. 2 and 3, the slope of the surface of the handle fork member free end 148 matches the slope of the surface of the frame fork member free end 134. The wedge 112 and notch 114 arrangement provide additional means with matching surfaces of the handle fork member free end 148 and the frame fork member free end 134 for keying the handle 124 to the frame 122. A slide coupling 152, shown in FIG. 7 in the first position like that for slide coupling 52 in FIG. 4, also functions as a structural enhancement functioning as slide coupling 52. Slide coupling 152 is anchored in the first position by dowel pins, as dowel pin 176 shown in FIG. 8, in the manner in which slide coupling 52 is anchored by dowel pins, for example dowel pin 76 of FIG. 2.

Figure 9:
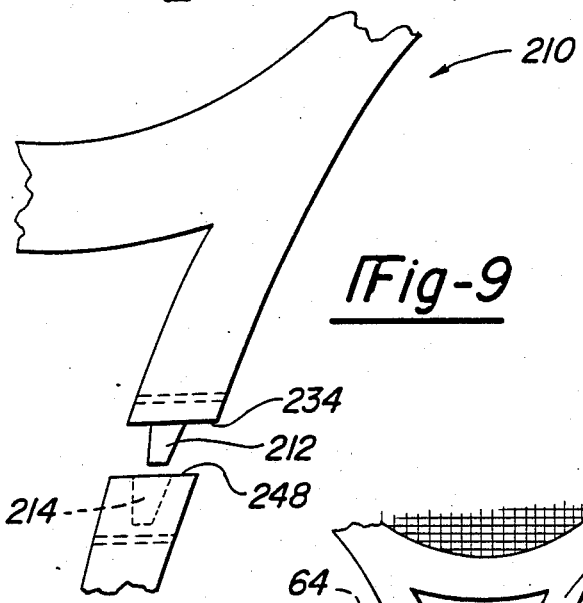
FIG. 9 is a detail corresponding to the details shown in FIGS. 6 and 7, showing a third embodiment of the present invention.
Figure 10:
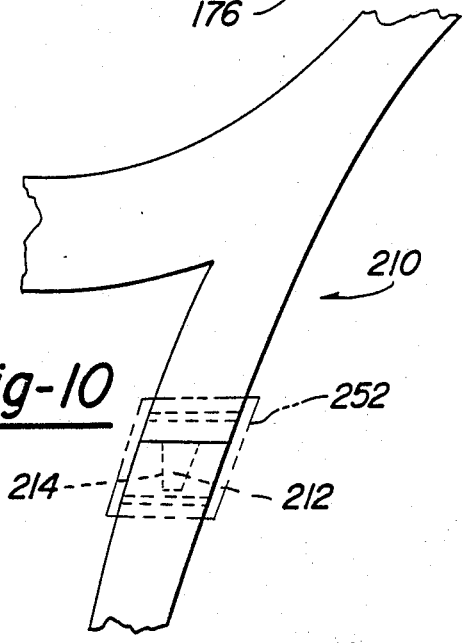
FIG. 10 is a detail of the embodiment shown in FIG. 9 with a keying and locking mechanism in place to rigidly attach the handle of the racquet to the frame of the racquet.

For racquet 210, shown in FIGS. 9 and 10, a dowel 212 projects from each frame fork member free end 234 (only one frame fork member free end 234 being shown). The dowel 212 in seated in a dowel-accommodating recess 214 of handle fork member free end 248, as shown in phantom in FIG. 10 (again, only handle fork member free end 248 being shown). As in the other embodiments of the invention, the surface of the handle fork member free end 148 matches the surface of the frame fork member free end 234. The dowel 212 and recess 214 arrangement provide yet another, additional means with matching surfaces of the handle fork member free end 248 and the frame fork member free end 234 for keying the handle 224 to the frame 222, with the structural enhancement of a slide coupling 252, shown in phantom in FIG. 10.

As described herein, the present invention overcomes the shortcomings of coventional racquets and other racquets known in the art by providing a racquet with a reinforced throat and detachable handle with reinforcing elements that stabilize the racquet against the shock of a colliding ball and allow the racquet to be detached and attached again without sacrificing the stability just described.

While the present invention has been described in its preferred embodiment, it is to be understood that the invention is not limited thereto and may otherwise embodied within the scope of the following claims:

We claim:

1. A tennis racquet having a stringed hitting surface and a detachable handle, the racquet comprising:

a frame, including an open frame portion completely surrounding the stringed hitting surface, and two frame fork members, each frame fork member extending, in convergence toward one another, from the open frame portion to a frame fork member free end, each frame fork member free end having a surface that is inclined to face generally away from the surface of the other frame fork member free end and each frame fork member having a threaded hole substantially therethrough and remote from the surface of the frame fork member free end, the frame fork members defining a fork opening between each other and each frame fork member defining a boundary of the fork opening;

the handle, including a forked end, a grip end, and a gripping shank disposed between the forked end and the grip end, the gripping shank having a substantially uniform cross-section over a portion of its length adjacent the grip end, the forked end having two handle fork members, each handle fork member corresponding to a frame fork member and each handle fork member secured to and extending from the gripping shank to a handle fork member free end while diverging from the other handle fork member, each handle fork member free end having a surface that is inclined to face generally toward the surface of the other handle fork member free end, the surfaces of the free ends of corresponding frame fork members and handle fork members mating in contiguous relationship to form a joint therebetween when the handle is attached to the frame, each handle fork member having a threaded hole substantially therethrough, remote from the surface of the handle fork member free end and each handle fork member having a first cross-section proximate the gripping shank and a second cross-section proximate the handle fork member free end, said first cross-section being greater than said second cross-section;

a pair of slide couplings, each slide coupling substantially surrounding a corresponding one of said handle fork members, each said slide coupling having a first end portion most proximate said gripping shank and said first end portion of slide coupling tightly gripping said handle fork member at said first cross-section when said slide coupling is in a first position whereat said slide coupling bridges at least a portion of the joint between the corresponding frame fork member and the corresponding handle fork member when the handle is attached to the frame, said slide coupling having a pair of holes, one of said pair of holes being in alignment with the hole of said handle fork member and the other of said pair of holes being in alignment with the hole of said frame fork member when said slide coupling is at said first position, and said slide coupling being slidable on said corresponding handle fork member to a second position whereat said slide coupling is away from said joint; and two pairs of screws, one screw of each pair of screws being received through one aligned hole of a slide coupling and threadably received by the hole of the corresponding frame fork member and the other screw of each pair of screws being received through the other aligned hole of the slide coupling and threadably received by the hole of the corresponding handle fork member to secure said slide coupling at said first position and to secure said corresponding frame fork member to said corresponding handle fork member.

2. The tennis racquet described in claim 1, wherein each slide coupling has at least one hole and each frame fork member has at least one threaded hole opening communicably with the at least one hole of said slide coupling when said slide coupling is placed in the first position, and wherein at least one threaded screw is receivable through said at least one hole and threadably receivable into said at least one threaded hole to secure said slide coupling to said frame fork member with said slide coupling in the first position.

3. The tennis racquet described in claim 1, wherein a wedge projects from each frame fork member free end and wherein each handle fork member free end has a wedge-accommodating notch, the wedge seatable in the wedge-accommodating notch so as to provide additional means for keying the handle to the frame.

4. The tennis racquet described in claim 1, wherein a dowel projects from each frame fork member free end and wherein each handle fork member free end has a dowel-accommodating recess, the dowel receivable by the dowel-accommodating recess so as to provide additional means for keying the handle to the frame.

5. A tennis racquet having a stringed hitting surface and a detachable handle, the racquet comprising:

a frame, including an open frame portion completely surrounding the stringed hitting surface, and two frame fork members, each frame fork member extending, in convergence toward one another, from the open frame portion to a frame fork member free end, the frame fork member free ends having surfaces that slope outwardly from the convergence of the two frame fork members, the frame fork members defining a fork opening between each other and each frame fork member defining a boundary of the fork opening;

the handle, including a forked end, a grip end, and a gripping shank disposed between the forked end and the grip end, the gripping shank having a substantially uniform cross-section over a portion of its length adjacent the grip end, the forked end having two handle fork members, each handle fork member tapering to the gripping shank so as to have a cross-section proximate the handle fork member free end that is thicker than the cross-section proximate the gripping shank, each handle fork member corresponding to a frame fork member and each handle fork member secured to and extending from the gripping shank to a handle fork member free end, while diverging from the other handle fork member, the handle fork member free ends having corresponding surfaces that slope inwardly to match the surfaces of the frame fork member free ends when the handle is attached to the frame; and keying and locking means for rigidly attaching each frame fork member to a corresponding handle fork member, including slide couplings, each slide coupling being positionable to bridge a joint between the matching surface of a frame fork member free end and a corresponding handle fork member free end when said each slide coupling is placed in a first position and permitting each frame fork member to be detached from the corresponding handle fork member when the slide coupling is placed in a second position, each said slide coupling substantially surrounding said corresponding handle fork member, with respect to which said slide coupling is positionable, proximate said handle fork member free end, said slide coupling being capable of substantially surrounding the frame fork member, with respect to which said slide coupling is positionable, proximate the frame fork member end, said slide coupling having tapering interior walls to match the taper of said handle fork member so as to fit snugly on said frame fork member and said handle fork member as said frame fork member and said handle fork member are joined at the matching surfaces of said handle fork member free end and said frame fork member free end when the positionable means of the slide coupling is placed in the first position, the snug fit of the slide coupling on said handle fork member providing means for keeping said slide coupling from falling off said handle fork member when the frame is detached from the handle.

* * * * *